US005407375A

United States Patent [19]

Johnson

[11] Patent Number: 5,407,375

[45] Date of Patent: Apr. 18, 1995

[54] TOY ROCKET WITH VELOCITY DEPENDENT CHUTE RELEASE

[76] Inventor: Lonnie Johnson, 1640 Roswell St., Ste. A, Smyrna, Ga. 30080

[21] Appl. No.: 165,647

[22] Filed: Dec. 8, 1993

[51] Int. Cl.[6] ..... A63H 33/20; A63H 27/00; A63H 33/00

[52] U.S. Cl. ..... 446/52; 446/49; 446/486

[58] Field of Search ..... 446/49, 50, 51, 52, 446/53, 54, 486

[56] References Cited

U.S. PATENT DOCUMENTS

| | | | |
|---|---|---|---|
| D. 158,700 | 5/1950 | Weldon | 446/50 |
| 1,938,931 | 12/1933 | Newman | 446/51 |
| 2,008,107 | 7/1935 | Norden | 446/49 |
| 2,023,124 | 12/1935 | Dickover | 446/52 |
| 2,126,156 | 8/1938 | Vogt | 446/51 |
| 2,312,629 | 3/1943 | Culver | 446/51 |
| 2,559,458 | 7/1951 | Orr | 446/52 |
| 2,568,475 | 9/1951 | Vaughan | 446/52 |
| 2,607,159 | 8/1952 | Hunt et al. | 446/51 |
| 3,086,317 | 4/1963 | Quercetti | 446/52 |
| 3,218,755 | 11/1965 | Quercetti | 446/52 |
| 3,375,606 | 4/1968 | Francis | 446/49 |
| 3,415,010 | 12/1968 | Belz | 446/52 |
| 3,822,502 | 7/1974 | Belz | 446/52 |
| 4,038,776 | 8/1977 | Filipeli | 446/52 |
| 4,840,598 | 6/1989 | Schuetz | 446/49 |

*Primary Examiner*—Robert A. Hafer
*Assistant Examiner*—Jeffrey D. Carlson
*Attorney, Agent, or Firm*—Hopkins & Thomas

[57] ABSTRACT

A toy rocket with velocity dependent chute release comprises an elongated generally cylindrical fuselage formed with a cavity along one side. The cavity is sized to receive and contain a folded parachute. An elongated hatch is hingedly attached to the fuselage and is movable at its hinged attachment between a first position covering the cavity and constraining the parachute therein and a second position displaced from and opening up the cavity for deployment of the parachute. A latch mechanism releasably secures the hatch in its closed position. A trigger assembly includes a flap that is presented to the wind during flight of the rocket and that has a first position securing the latch mechanism and a second position releasing the latch mechanism to open the hatch. The flap is oriented such that the force of the impinging wind urges the flap to its first position. The latch is spring biased toward its second position with a biasing force chosen to move the flap to its second position when the force of the wind on the flap falls below a predetermined value thus releasing and deploying the parachute when the rocket slows to a selected speed.

8 Claims, 4 Drawing Sheets

TOY ROCKET WITH VELOCITY DEPENDENT CHUTE RELEASE

TECHNICAL FIELD OF THE INVENTION

The present invention relates generally to toys and hobby items and more particular to toy and model rockets.

BACKGROUND OF THE INVENTION

For decades, toy rockets have been popular playthings for children of all ages. Such rockets have been made available in all shapes and sizes and many models have been provided with their own propellant, such as pressurized water, pressurized air, or the like. The popularity of toy rockets has even extended to adolescent and adult hobbies in the form of model rockets propelled by solid fuel rocket engines. As a matter of fact, model rocket enthusiasts often spend countless hours constructing model rockets that are large and extremely realistic. Such model rockets typically require a substantial financial investment and can be extremely valuable items for their owners.

Most toy rockets that have been the playthings of children are designed to be launched by one of various means into the air for flight. Rarely, however, have toy rockets been provided with deployable parachutes. Thus, once launched, toy rockets simply follow a trajectory up and then back down to the ground where they impact the earth. Since toy rockets are sturdy and follow relatively low altitude trajectories, their impact with the ground rarely causes damage and they are simply retrieved and launched again.

One type of toy rocket that functions in this way is commonly known as the "Nerf®" rocket. Nerf rockets usually have an elongated cylindrical fuselage that is made of a foam rubber material and that has fins affixed to and extending outwardly from the tail of the rocket. In use, nerf rockets, like many other toy rockets, are propelled from a launcher by means of compressed air, whereupon they follow natural trajectories up and back to the earth.

In contrast to toy rockets, model rockets that are propelled by solid fuel rocket engines commonly are provided with parachutes that are deployed during flight of the rocket to ease the rocket gently back to the earth when its engines are spent. A parachute is desirable for model rockets because these rockets typically are heavier and more fragile than toy rockets and are propelled to much higher altitudes. Accordingly, if these model rockets are allowed to fall naturally back to earth, they can easily be destroyed upon impact with the ground. This is a particularly acute problem with large expensive model rockets, which sometimes include parachutes for each stage as well as redundant parachutes for more expensive portions of the rocket.

In model rockets, the parachute usually is folded and stowed in the nose-cone section of the rocket during flight. For deployment of the parachute, the nose-cone typically is ejected by means of an explosive charge that is activated as the rocket's engines burn out. With the nose-cone thus ejected, the parachute can unfold and deploy for easing the rocket body back to earth.

While such methods of deploying parachutes from model rockets have been relatively successful in the past, they nevertheless have been plagued with numerous problems and shortcomings inherent in their respective designs. For example, the explosive charge that ejects the nose-cone and deploys the chute usually is triggered by the burning engine of the model rocket. Ideally, it is desirable that the explosive charge occur after the engine has burned out. However, such accurate timing has proved elusive such that chute deployment sometimes occurs while the main engine is still burning or occurs after the rocket has reached apogee and is falling back to earth. In addition, the explosive charges that deploy the chutes must be replaced after each flight, which is tedious and time consuming and can become expensive after numerous flights. Also, it is not uncommon that the explosive charge designed to deploy the parachute fails to fire, whereupon a potentially expensive model rocket plummets back to earth and is destroyed.

As mentioned above, unlike model rockets, most toy rockets are not provided with parachutes. This is because toy rockets usually are inexpensive and rugged enough to withstand an impact with the earth. Further, there has previously been no convenient method of deploying a parachute from a toy rocket since there is no burning engine that can be used to trigger a chute deployment charge. Nevertheless, parachutes have been found to be amusing to children who play with toy rockets. It is thus desirable that toy rockets do deploy parachutes at the apogees of their trajectories to ease them back to earth and, in the process, to amuse their owners.

In the past, a few toy rockets have been provided with makeshift parachutes, but the chutes usually are simply wrapped around the body of the rocket and the rocket thrown or propelled into the air. With these types of toy rockets, the chute simply unwinds as the rocket tumbles upwardly through the air and, when fully unwound, deploys to stop the upward movement of the rocket and ease it back to earth. Obviously, such a method of stowing and deploying a parachute is highly undesirable since the rocket tends to tumble as it moves upwardly and does not fly straight through the air. Further, the time at which the chute deploys is completely uncontrollable and the chute rarely deploys at the apogee of the rocket's trajectory, where deployment is most desirable.

Thus, a continuing and heretofore unaddressed need exists for a parachute deployment mechanism for use both with toy and model rockets that does not require an explosive charge for deployment of the chute, does not interfere with the normal upward trajectory of the rocket, that deploys the parachute reliably and accurately at the apogee of the rocket's trajectory regardless of the time during the flight that such apogee occurs, and that is simple and easy to use without requiring replacement of any spent parts between flights. Such a chute deployment mechanism should be equally adaptable to both model and toy rockets and should require no explosive charge for deployment. The mechanism should be reliable and should always deploy the chute when the rocket slows to a predetermined low velocity near the apogee of the rocket's trajectory. It is to the provision of such a parachute deployment mechanism and to a rocket and launch system employing such a mechanism that the present invention is primarily directed.

SUMMARY OF THE INVENTION

Briefly described, the present invention, in a preferred embodiment thereof, comprises a toy rocket with a velocity dependent chute release mechanism. The rocket is formed with an elongated generally cylindrical fuselage having a nose section at its front end and a tail section at its rear end. An elongated cavity is formed along one side of the fuselage with the cavity being sized and configured to receive and contain a folded parachute of common construction.

An elongated curved hatch is hingedly affixed to the fuselage at the base of the cavity. The hatch is movable at its hinged attachment between a first position covering and closing the cavity for confining the parachute to the cavity and a second position displaced from and opening the cavity for releasing the parachute from the cavity for deployment. A spring at the hinged attachment normally biases the hatch to its open position. A latch mechanism is provided at the nose section of the rocket for releasably latching the hatch in its closed position against the bias of the spring to confine the parachute to the cavity during upward flight of the rocket.

A wind velocity sensitive release trigger is mounted to the toy rocket fuselage at its nose section. The release trigger is operably coupled to the latch mechanism of the hatch and includes a flap that is movable between a first position securing the latch and a second position releasing the latch for opening the hatch and deploying the parachute. The flap includes a surface that is presented to the wind as the rocket moves through the air and is oriented such that the force of the wind on the surface tends to urge the flap to its first position securing the latch.

Spring means, which can be a rubber band as in the preferred embodiment, is positioned for spring biasing the flap toward its latch releasing second position. The spring means is selected to provide a biasing force on the flap that is less than the force of the wind on the surface of the flap when the rocket is moving faster than a predetermined relatively slow velocity and that is greater than the force of the wind on the flap when the rocket slows to a speed less than the predetermined velocity. Thus, when the rocket is launched and as it moves upwardly along its trajectory, the pressure of the wind holds the flap down against the bias of the spring means thus securing the latch and keeping the hatch closed securely over the folded parachute in the cavity. However, when the rocket slows to a speed less than the predetermined velocity, the spring means overcomes the force of the wind and urges the flap to move from its first position to its second position thereby releasing the latch and allowing the hatch to open for deployment of the parachute. As the flap moves, it flops backward into the wind stream, which provides additional opening force.

In practice, the biasing force of the spring means on the flap and the area of the surface presented to the wind are selected such that chute deployment occurs at a relatively slow speed just before the apogee of the rocket's trajectory. In this way, the chute is always deployed at the apogee of the trajectory regardless of the force with which the rocket is launched or the altitude to which it climbs. Once the chute is deployed, the rocket is simply eased to the ground by the parachute where it can be recovered. When recovered, the chute can be refolded and inserted into the cavity whereupon the hatch is closed and latched in preparation for another launch of the rocket.

It is thus seen that a toy rocket is now provided with a chute release mechanism that is dependent on the velocity of the rocket, does not require an explosive charge, accurately deploys the chute at the apogee of the rocket's trajectory, is simple and efficient to operate, and that is equally adaptable either to model rockets or toy rockets, or, for that matter, any type of projectile that requires deployment of a parachute. An efficient simple-to-operate pressurization and launch system is also provided for launching the toy rocket into the air for flight. These and other features, objects, and advantages of the invention will become more apparent upon review of the detailed description set forth below taken in conjunction with the accompanying drawings, which are briefly described as follows.

DETAILED DESCRIPTION OF THE PREFERRED EMBODIMENT

Figure 1:
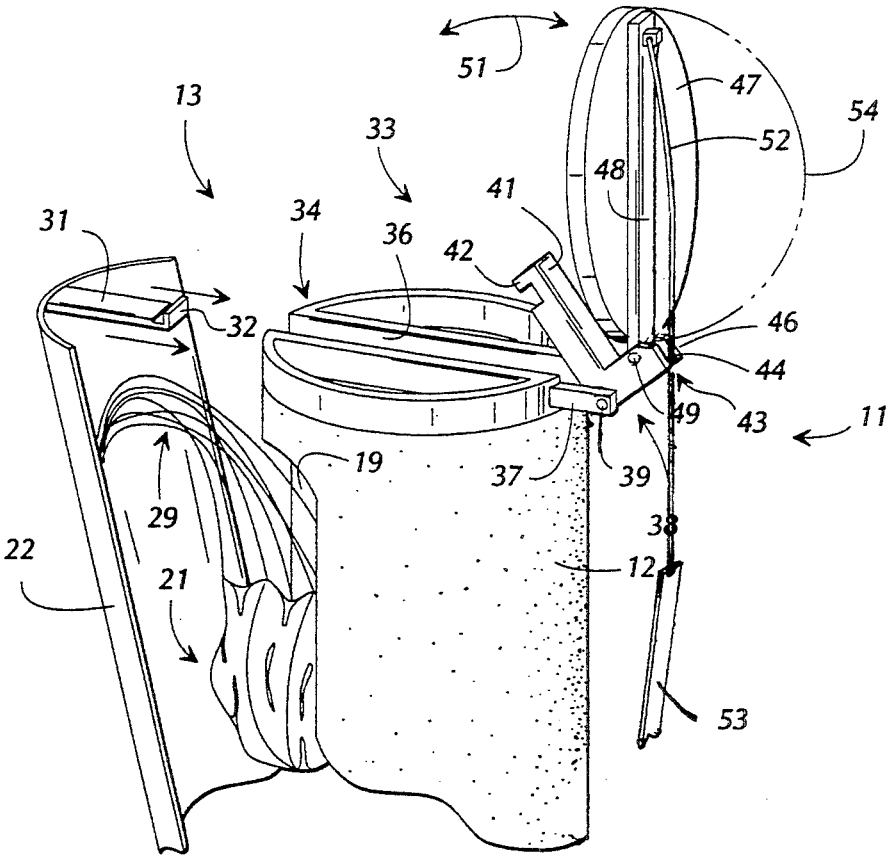
FIG. 1 is a perspective view of the nose-cone section of a toy rocket embodying principals of the present invention in a preferred form.

Referring now to the drawings, in which like numerals refer to like parts throughout the several views, FIG. 1 is a perspective view illustrating the nose-cone section of a toy rocket that embodies principals of this invention in a preferred form. The rocket 11 comprises a generally cylindrical elongated fuselage 12 having a nose section 13 at its top end and a tail section 14 (FIG. 5) at its bottom end. The tail section 14 is provided with a plurality of fins 15 for stabilizing the rocket during flight. Also, in the preferred embodiment, the tail end section 14 of the rocket is provided with a longitudinal bore extending through the bottom of the fuselage. The bore is sized to receive the launch tube 17 of a launcher 18, which is designed to propel the rocket into the air by means of a burst of compressed air, as detailed below. It will be understood by those of skill in this art, however, that numerous and varied means of launching the rocket into the air might be employed including, for example, catapult mechanisms, coil spring launchers, or, in the case of model rockets, solid fuel rocket engines. Thus, the particular launching mechanism illustrated as a preferred embodiment should not be interpreted as a limitation of the invention but only exemplary of a preferred launcher for use with toy rockets.

In the preferred embodiment, the fuselage 12 of the rocket 11 is formed from a foam material so that the rocket is relatively light and safe for children. A longitudinally extending cavity 19 is formed along one side of the fuselage 12. Preferably, the cavity 19 is formed integrally with the fuselage during the molding thereof, but could also be machined into the fuselage after molding. The cavity 19 is sized and configured to receive and contain a folded parachute 21 of conventional construction as best illustrated in FIG. 1.

Figure 2:
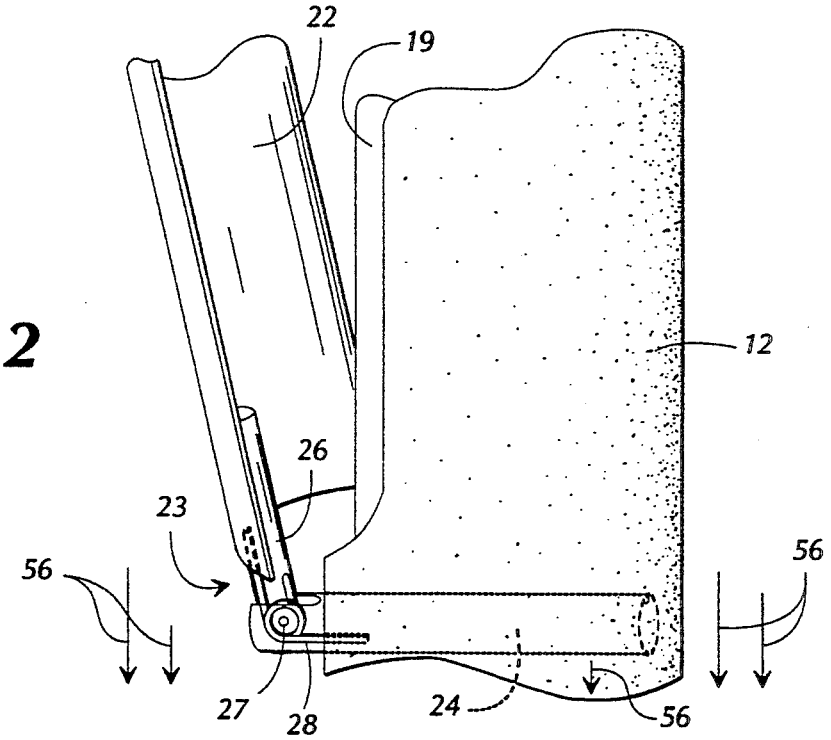
FIG. 2 is a perspective view of a portion of the fuselage of the rocket of FIG. 1 illustrating the hinged attachment of the hatch to the rocket fuselage for opening and closing the cavity.

An elongated curved hatch 22 has a lateral curvature corresponding to the curvature of the rocket fuselage 12. As illustrated in FIG. 2, the hatch 22 is affixed to the fuselage 12 just beneath the lower extent of cavity 19 by means of a spring biased hinge mechanism 23. The hinge mechanism 23 includes a first portion 24 that is embedded within the fuselage 12 and protrudes outwardly therefrom beneath the cavity 19. A second portion 26 of the hinge mechanism is fixed to the hatch 22 and is hingedly coupled to the first portion 24 by means of a hinge pin 27. A small coil spring 28 is disposed about the hinge pin and is arranged to bear with tension against the second portion 26 of the hinge mechanism to spring bias the hatch 22 toward its open position as best illustrated in FIG. 2.

With the just described hatch configuration, it can be seen that the hatch 22 is movable at its hinged attachment between a first position covering and closing the cavity 19 for confining the folded parachute to the cavity and a second position displaced from and opening up the cavity 19 for deployment of the parachute. A plurality of parachute cords 29 (FIG. 1) are each attached at one end to the periphery of the chute and the cords are all fixed at their other end to the interior portion of the hatch 22 near its upper extent. In this way, when the hatch moves from its closed position to its open position, the moving hatch pulls the parachute cords 29 and thus the chute 21 out of the cavity 19 thus ejecting the parachute from the cavity for quick and reliable deployment of the chute.

Figure 3:
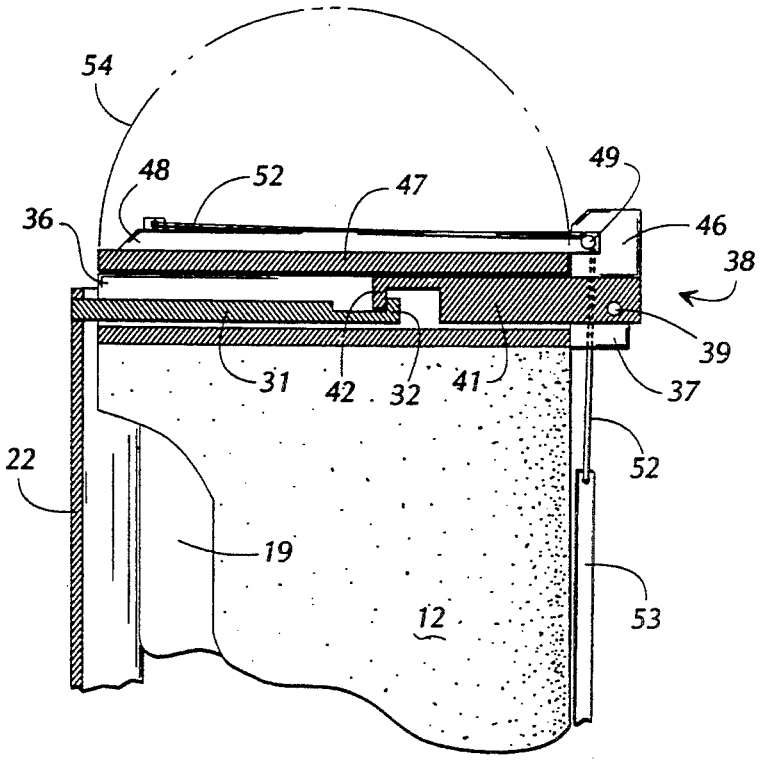
FIG. 3 is a sectional view of the nose end section of the rocket showing the chute release mechanism latched in place for flight and illustrating the relative placement and configuration of the various elements of the invention.

Referring to FIGS. 1 and 3, an elongated latch pin 31 is attached to and extends inwardly from the top portion of the hatch 22 toward the rocket body. The free end of the latch pin 31 is formed with an upwardly extending tang 32 that is used, as detailed below, to secure the latch pin 31 and thus the hatch 22 in a closed position during flight of the rocket.

A velocity dependent chute release mechanism 33 is adhesively fixed to the top of the rocket fuselage 12. The mechanism 33 is designed to release the latch pin 31 and thus open the hatch 22 to deploy the chute when the rocket slows to a predetermined, relatively small velocity. The release mechanism 33 comprises a base plate 34 formed with a diametrically extending groove 36. The groove 36 is sized and positioned to receive the latch pin 31 of the hatch 22 as the hatch is moved to its closed position covering the cavity 19. The position of the latch pin 31 relative to the groove 36 when the hatch is in its closed position is best illustrated in FIG. 3.

A spaced pair of hinge blocks 37 protrude from the base plate 34 on either side of the groove 36 opposite the end of the groove into which the latch pin 31 is received. A generally L-shaped latch keeper 38 is pivotally mounted between the hinge blocks 37 on a hinge pin 39. The latch keeper 38 has a first leg 41 that is sized and located to move into the groove 36 as the latch keeper pivots about hinge pin 39 inwardly toward the rocket. A downwardly extending tang 42 is formed at the end of the first leg 41 and is positioned to capture the upwardly extending tang 32 of the latch pin 31 when the hatch 22 is closed, as best illustrated in FIG. 3. In this way, when the latch keeper is fully pivoted to the closed orientation in which it is illustrated in FIG. 3, it functions to hold the latch pin 31 securely in place thus releasably latching the hatch 22 in its closed position. Naturally, when the latch keeper is hinged back in a clockwise direction as viewed in FIG. 1, the latch pin 31 is released permitting the hatch 22 to spring open under the influence of coil spring 28.

A disc-shaped flap 47 is fixed to a diametrically extending elongated hinge bar 48. One end of the hinge bar 48 extends beyond the periphery of the flap 47 and is disposed and pivotally secured on a hinge pin 49 between the spaced halves 44 and 46 of the latch keeper's second leg 43. With this configuration, the flap 47 is pivotable relative to the latch keeper about hinge pin 49 in the directions indicated by arrow 51. It can thus be seen that the latch keeper 43 is pivotable relative to the base plate 34 about hinge pin 39 and that the flap 47 is pivotable relative to the latch keeper 43 about hinge pin 49. Further, hinge pin 49 is inwardly displaced toward the rocket relative to the hinge pin 39. As discussed below, this offset double-hinged arrangement of the latch keeper and flap functions to insure that the hatch 22 remains securely closed and latched during rocket flight even if the flap 47 should flutter or otherwise move slightly about its hinged attachment.

A small cord or thread 52 is fixed at one end to the free end of the hinge bar 48 and extends therefrom to its other end, which is fixed to the end of a rubber band 53. The rubber band 53, in turn, extends downwardly toward the tail end of the rocket fuselage 12, where it is affixed to the fuselage by means of adhesive or another appropriate fastener. The cord 52 and the rubber band 53 have respective lengths that are chosen to insure that the rubber band and cord are slack when the flap and latch keeper are open as illustrated in FIG. 1, but become tight and tensioned when the latch keeper and flap are closed as illustrated in FIG. 3. Furthermore, the size of and thus tension provided by the rubber band is selected such that when the flap 47 is closed as shown in FIG. 3, the rubber band and cord tend to create a small torque or force on the flap 47 that acts to bias the flap toward its open position.

While a rubber band in conjunction with a cord has been illustrated in the preferred embodiment, it will be understood that the cord is not an essential element of the embodiment. The rubber band itself might be configured to extend the full distance spanned by the band and the cord, thus eliminating the necessity of the chord altogether.

Naturally, while a rubber band or rubber band and cord for biasing the flap has been illustrated, it will be understood by those of skill in the art that various other means, such as a spring, for biasing the flap toward its open position might also be employed with comparable results. For example, a spring might be used in place of the rubber band or a spring might be integrated into the offset double-hinged attachment of the latch keeper and flap to create a comparable biasing force. Therefore, the rubber band and cord of the illustrated embodiment should not be considered a limitation of the invention but only exemplary of one biasing methodology that is known to function adequately. Further, although not functionally required, in actual commercial use, a nosecone 54 preferably is fixed to and covers the flap 47 to provide a pleasing and realistic aesthetic appearance for the nose section of the rocket 13.

FIG. 3 illustrates in cross-section the nose-cone of the rocket and the chute release mechanism as they appear with the parachute packed in the cavity 19 and the rocket ready for launch. Here, the hatch 22 is seen to be closed to cover the cavity 19 and confine the parachute therein. With the hatch closed, its latch pin 31 extends into the groove 36 of the base plate 34. The flap 47 is seen to be in its closed position with the cord 52 extending tautly from the end of the hinge bar 48 over the hinge pin 49 and thence downwardly to the end of the rubber band 53.

Since the hinge pin 49 is offset and inwardly displaced toward the rocket relative to the hinge pin 39, the downwardly directed tension provided by the rubber band on the hinge pin 49 creates torque on the latch keeper 38 that tends to pivot the latch keeper in a counter-clockwise direction about its hinge pin 39 and hold the latch keeper securely in its closed position. In addition, when the latch keeper 38 and the flap 47 are in their closed positions as shown in FIG. 3, the moment arm about hinge pin 49 is very small. In fact, the moment arm under these conditions is roughly equal to the distance between the center of hinge pin 49 and slightly beyond the radius of the hinge pin itself. Thus, the torque created by the rubber band about hinge pin 49 tending to open the flap is comparably small. This means that it is easy for the force of the wind to hold the flap down against the small torque when the rocket moves rapidly.

However, as the rocket slows to near zero velocity, the small torque about hinge pin 49 is sufficient to begin to open the flap against the force of the wind. As the flap moves, the rubber band and cord move outwardly away from hinge pins 49 and 39, as best illustrated in FIG. 1. Thus, the moment arm about hinge pin 49 and about hinge pin 39 increases as the cord moves away from the hinge pins. Therefore, as the flap opens, the torque and force tending to open it increases with the increasing length of the moment arm thus pulling the flap with increasingly greater force. When the flap ultimately engages the second leg 46 of the latch keeper, the torque is applied to the latch keeper itself tending to rotate it about hinge pin 39 to its open position. This torque, in conjunction with the force of any wind on the bottom of the flap, is more than sufficient to overcome any friction between the tangs 42 and 32 so that the latch pin 31 is released quickly and reliably. Accordingly, with the double hinged arrangement of the flap and latch keeper, once the flap begins to open, it flips open quickly to release the chute.

In the closed position of the latch keeper, the downwardly extending tang 42 captures the upwardly extending tang 32 of the latch pin 31 to latch and hold the hatch 22 securely in its closed position covering the cavity 19 as shown. It can thus be seen that even if the flap 47 flutters or even pivots a significant amount about hinge pin 49, the downward force of the rubber band 53 and cord 52 on the offset hinge pin 49 still continues to apply torque to the latch keeper 38 and thus maintains the latch keeper securely in its closed latched position.

Figure 4:
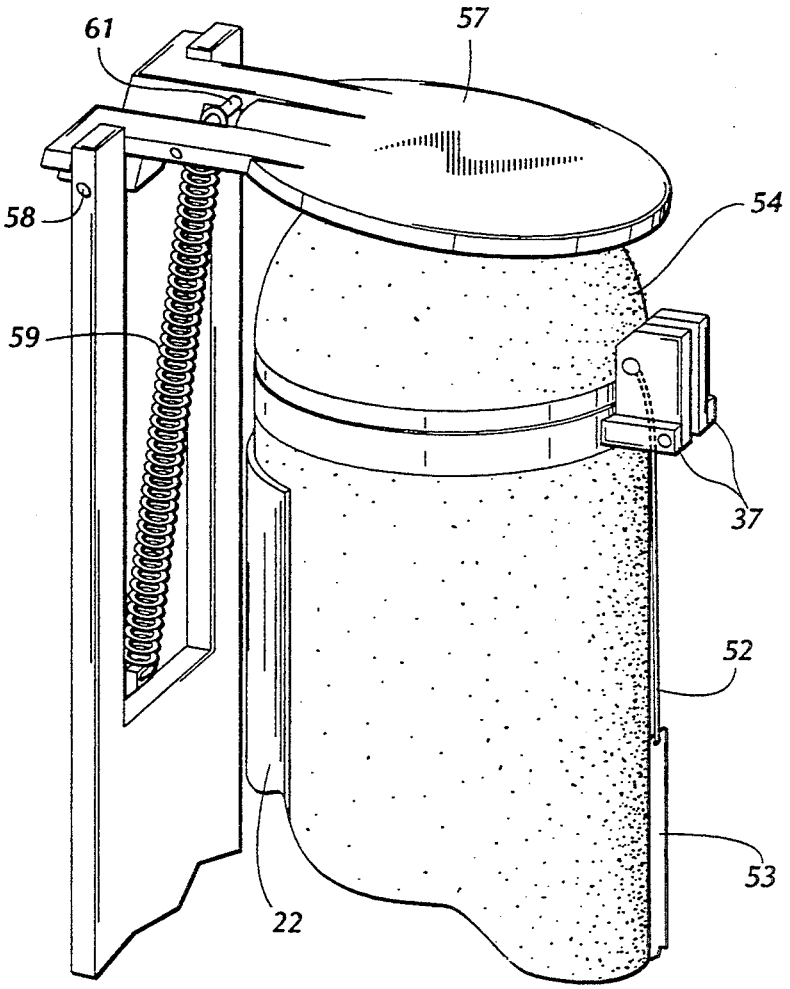
FIG. 4 is a perspective view showing that the nose-cone section of the toy rocket of this invention as it appears when closed, latched and mounted on a launcher for flight.

FIG. 4 illustrates the nose section of the rocket as it appears on the launcher prior to launch. It can be seen in this Figure that the parachute has been folded and placed into the cavity, the hatch 22 closed over the cavity, and the latch keeper 38 and nose-cone 54 closed to latch and hold the hatch 22 in place. The launcher is provided with a paddle 57 that is hingedly mounted to the launcher structure by means of a hinge pin 58. A coil spring 59 is secured at one end to the launcher and is secured at its other end to a spring pin 61, which is inwardly displaced toward the rocket from the hinge pin 58. Thus, the spring 59 tends to hold the paddle 57 securely down against the top of the rocket's nose-cone 54 to prevent the nose-cone from being sprung to its open position prior to launch by the tension of the rubber band 53. Therefore, the paddle 57 and spring 59 function to hold the chute release mechanism closed while the rocket is on the launching pad.

When the rocket is launched, the paddle 57 is forced by the moving rocket to pivot rearwardly until its spring pin 61 rotates around and becomes rearwardly displaced relative to the hinge pin 58. At this point, the force of the spring 59 on the hinge pin 61 flips the paddle 57 backwardly and holds it open so that it does not interfere with movement of the rocket body as the rocket leaves the launcher.

In use of this invention, the rocket is launched into the air for flight by means of a compressed air or other launching mechanism. Immediately upon launch of the rocket, the paddle 57, which holds the nose-cone and latch down on the launcher, is pushed aside. The initial acceleration of launch acting on the rocket tends to hold the flap 47 and thus nose-cone 54 downwardly in the closed position illustrated in FIG. 4.

Once the rocket leaves the launcher, it moves through the air with substantial velocity. This results in the movement of wind past the body of the rocket as indicated by arrows 56 in FIG. 2. The wind impinging upon and compressing against the nose-cone 54 of the rocket 13 causes a force that acts downwardly against the nose-cone. This force tends to take over where the acceleration of launch left off to hold the flap 47 downwardly in its closed latching position as the rocket moves through the air. As the rocket slows on its upward trajectory, the force created by the wind gradually lessens until, near the apogee of the trajectory, the velocity of and force created by the wind becomes very small compared to its initial value.

As the force created by the moving wind on the nose-cone lessens, it ultimately reaches a magnitude that is smaller than the magnitude of the counteracting bias force created on the flap by the cord 52 and rubber band 53. At this point, the biasing force overcomes the force of the wind and causes the nose-cone and flap to pivot rearwardly about hinge pin 49 to their open position. As the flap pivots under the influence of the rubber band and cord, it ultimately engages the second leg 43 of the latch keeper 38. Further movement of the flap, then, draws the latch keeper back causing it to pivot rearwardly about latch pin 39 out of its closed position and toward its open position. The downwardly extending tang 42 of the latch keeper 38 is thus withdrawn from the groove 36. This releases the upwardly extending tang 32 on the latch pin 31 and thus frees the latch pin.

With its latch pin freed, the hatch 22 is sprung open under the influence of spring 28. As the hatch opens, it pulls the chute cords 29 and the parachute 21 out of the cavity 19 thus deploying the chute rapidly and reliably from the rocket. Once deployed, the chute eases the rocket back to earth in the usual way.

In practice, it is desirable that the parachute be deployed just prior to the apogee of the rocket's trajectory, regardless of the initial force with which the rocket is launched or the altitude to which it climbs.

This insures that the rocket complete its entire flight before deployment of the chute and that the rocket is not already plummeting to earth when the chute is deployed. To facilitate this desired goal, the size and tension of the rubber band 53 is selected so that the biasing force imparted to the flap 47 by the rubber band and cord is of a predetermined small magnitude corresponding to the force of the wind on the nose-cone when the rocket is traveling at a relatively slow predetermined velocity just prior to apogee.

The biasing force on the flap provided by the rubber band is thus less than the force of the wind on the flap when the rocket moves at speeds greater than the predetermined velocity and is greater than the force of the wind when the rocket slows to a speed less than the predetermined velocity. It will therefore be seen that when the rocket slows to a speed less than the predetermined velocity, the biasing force overcomes the force of the wind causing the flap and latch keeper to spring back to release the hatch and deploy the chute. Since the release of the chute is dependent upon the velocity of the rocket, the chute is consistently deployed at roughly the same time just before the apogee of the rocket's trajectory. Further, the deployment time is independent of the force with which the rocket is launched or the altitude to which it climbs. In addition, deployment of the chute does not depend upon an explosive charge or other event that is tied to the burn-out of an engine but is a function only of the velocity of the rocket. Thus, previous problems associated with deploying chutes from powered model rockets are avoided altogether.

Figure 5:
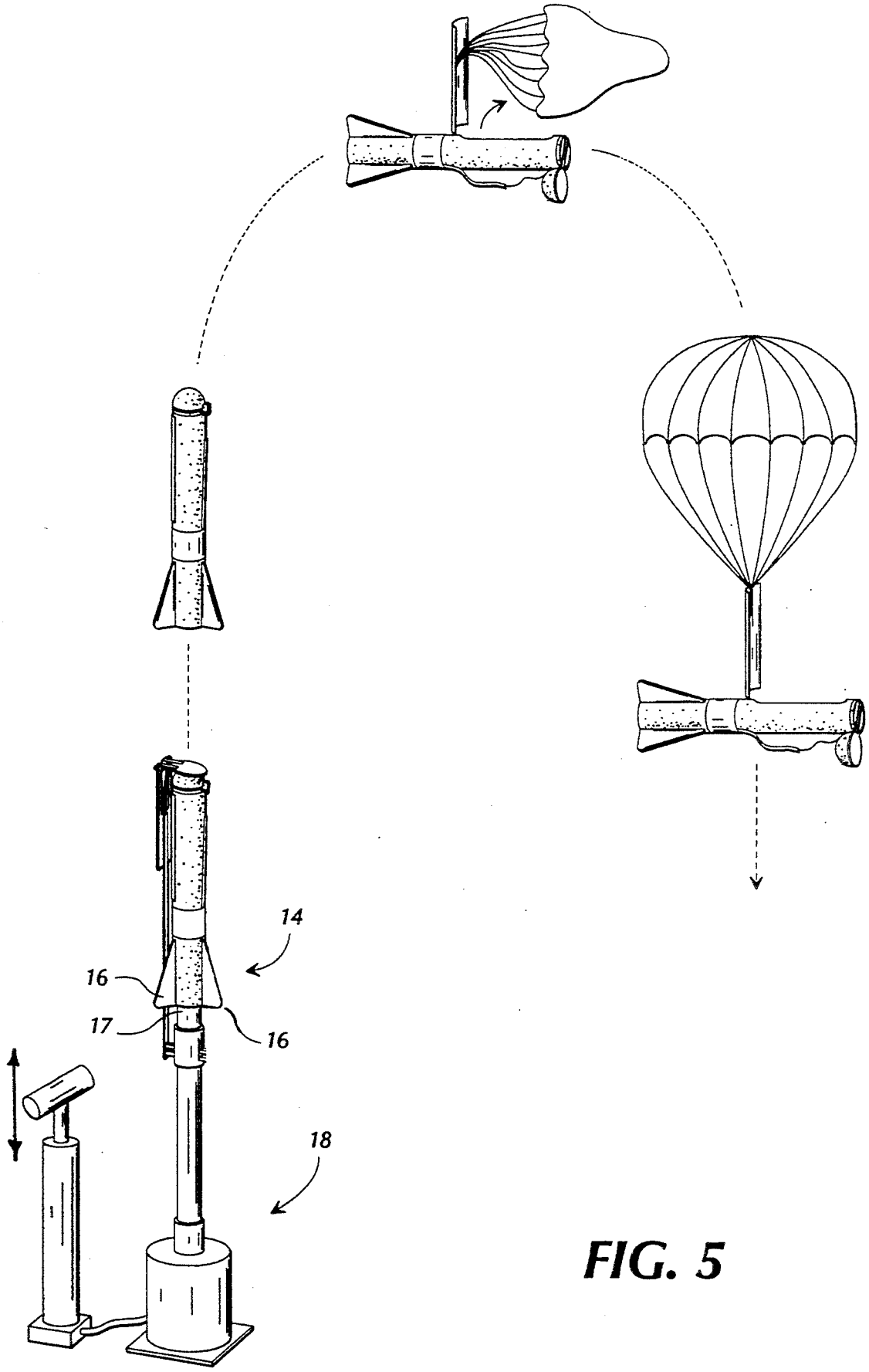
FIG. 5 is a sequence illustration showing stages of rocket flight from its prone position on the launcher to deployment of the chute at the apogee of the rocket's trajectory.

The just described cycle is illustrated in the sequence of FIG. 5. The first snapshot of the sequence shows the rocket mounted in a launch prone position on its launcher which, in this embodiment, comprises a compressed air launching mechanism. Once launched, the rocket travels upwardly at relatively high speed and the wind generated by the rocket's motion holds the nose-cone down thus keeping the chute hatch latched and closed. However, as the rocket slows near its apogee, the force of the wind is overcome by the biasing force of the rubber band 53, and the nose-cone 54, flap 47, and latch keeper 38 are hinged backward. This releases the latch pin and opens the hatch 22. As the hatch 22 opens, it pulls the parachute cords and the parachute out of the cavity 19, which results in the deployment of the parachute. Once deployed, the parachute eases the rocket body back to the ground where it can be recovered.

Figure 6:
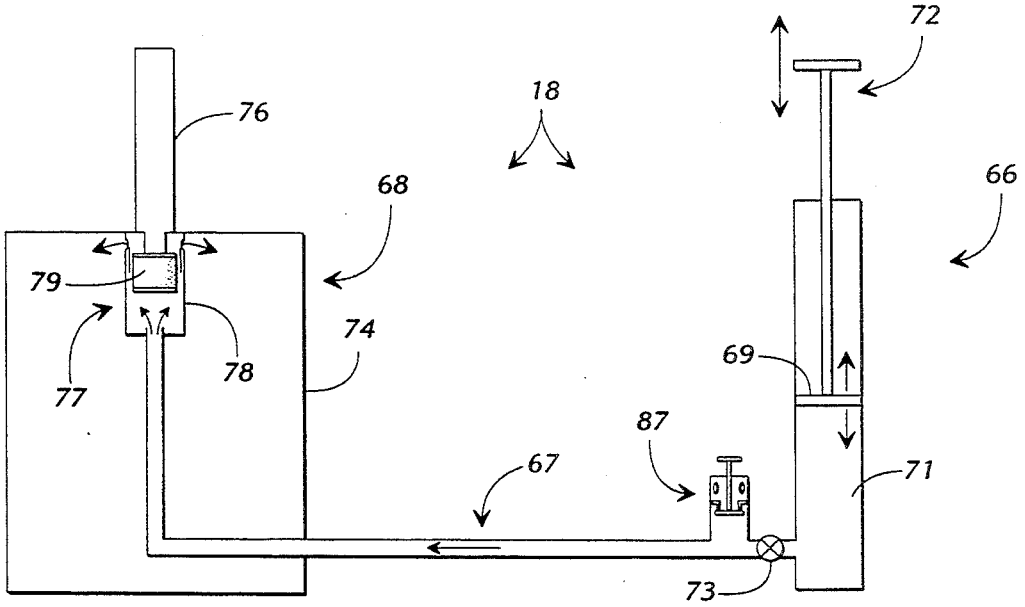
FIGS. 6 and 7 illustrate a preferred configuration and function of the pressurization and release value mechanism for launching the rocket of this invention into the air.
Figure 7:
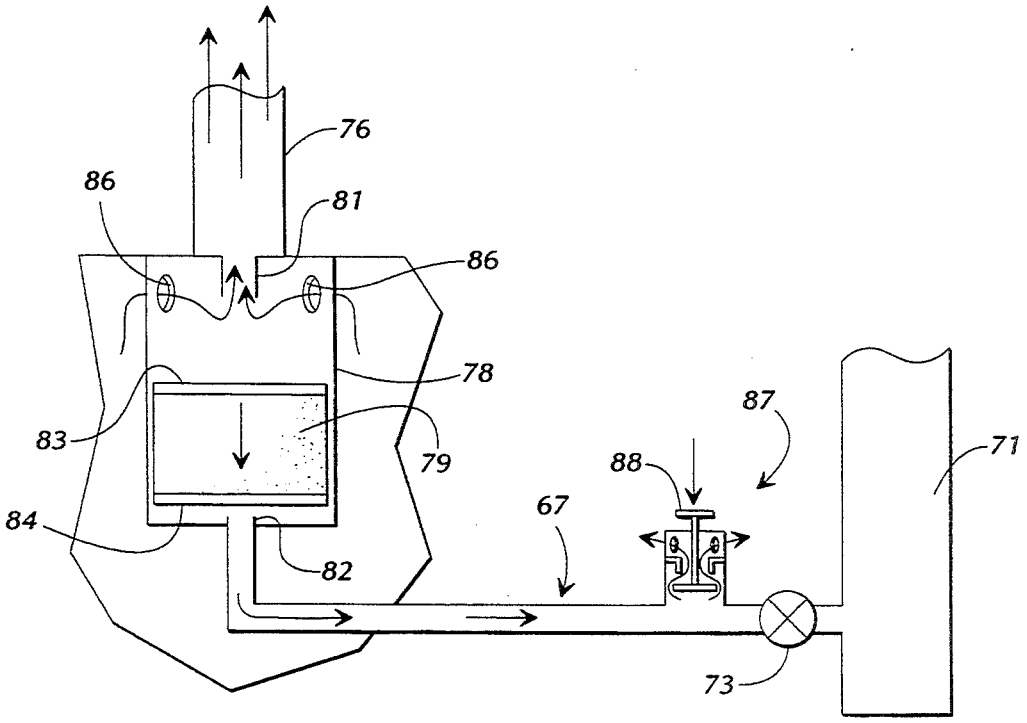

FIGS. 6 and 7 illustrate the mechanical functioning of the launcher 18 (FIG. 5). Specifically, FIG. 6 and 7 show in detail the pressurization and release mechanism employed to pressurize the launcher and selectively release the pressure through the launch tube to catapult the rocket into the air.

Launcher 18 is seen to comprise a manual pump 66 coupled through a hose 67 to the launcher base assembly 68. The pump 66 is of conventional construction and comprises a plunger 69 that can be reciprocated up and down within a pump cylinder 71 by means of a handle and push rod assembly 72. As the plunger 69 is manually reciprocated up and down within the cylinder 71, air is forced through the hose 67 to the launcher base assembly 68. A one-way check valve 73 prevents the movement of air through the hose 67 back to the pump 69.

The launcher base assembly 68 comprises a pressure chamber 74 from which a cylindrical hollow launch tube 76 upwardly extends. As seen in FIG. 5, in use, the toy rocket is slid over the launch tube 76 whereupon the release of pressure through the tube catapults the rocket into the air for flight.

A release valve assembly 77 is mounted within the pressure chamber 74 just beneath and communicating with the launch tube 76. As detailed below, the release valve assembly 77 functions to allow the pressure chamber 74 to be pressurized prior to launch of the rocket and also functions to release the pressure within the pressure chamber through the launch tube 76 when it is desired to launch the rocket. The release valve assembly 77 comprises a cylindrical manifold 78 that carries an internal cylindrical plunger 79. The plunger 79 fits relatively loosely within the manifold 78 such that it is free to slide up and down within the manifold.

The manifold 78 communicates at its upper end with the launch tube 76 and at its lower end with the hose 67, through which air is pumped by means of the pump 66. Seating lips 81 and 82 are formed about the ports that communicate with the launch tube 76 and hose 67 respectively. Seating gaskets 83 and 84 are provided on the upper and lower surfaces respectively of the plunger 79. With this configuration, it will be understood that when the plunger is slid upwardly to engage the lip 81, the gasket 83 seats and seals about the lip 81 to close off communication with the launch tube 76. Similarly, when the plunger is slid down within the manifold 78, the gasket 84 engages and seals about the lip 82 to close off communication with the hose 67. Finally, the manifold 78 is formed with a set of openings 86 disposed about its upper periphery. The openings 86 communicate with the interior of the pressure chamber 74 for purposes set forth in greater detail below.

A manually operable trigger valve assembly 87 is coupled in line with the hose 67. The trigger valve assembly 87 comprises a manually operable plunger 88 that can be depressed to release air pressure from within the hose 67 as best illustrated in FIG. 7.

The just described launcher functions as follows to catapult a rocket into the air for flight. First, the rocket is slid onto the launch tube 76 in its launch-prone position as shown in FIG. 5. The pump 66 is then operated causing air to be forced under pressure through the hose 67 and into the bottom of the manifold 78. The initial in-rush of air into the manifold drives the plunger 79 upwardly until it seats and seals against the lip 81 closing off communication with the launch tube 76. Air flowing through hose 67 then passes around the sides of the plunger 79 and exits the manifold through the openings 86. The exiting air creates pressure within the pressure chamber 74 and also within the manifold 78. This increased pressure, in turn, continues to hold the plunger 79 up against the lip 81. Continued operation of the pump 66, then, further pressurizes the chamber 74 and the pump is operated until the desired pressure level is achieved.

As an alternative to a loose fitting plunger with pressurized air passing around the sides of the plunger to pressurize the chamber through openings 86, the plunger could fit snugly and sealingly within the manifold to inhibit air passage around its sides. In such an embodiment, a second opening 95 might be formed in the manifold adjacent the second end thereof with the second opening communicating with the interior of the chamber through a one-way valve assembly 96. (Opening 95 and valve assembly 96 are shown in phantom lines in FIG. 7 as an alternate configuration.) With such an embodiment, compressed air supplied through the pressure tube 67 would pass through the second opening 95 to pressurize the chamber rather than passing around the plunger and through the openings 86.

With the pressure chamber 74 pressurized, the toy rocket can be launched into the air for flight by depressing the plunger 88 of the trigger valve assembly 87. Specifically, as best seen in FIG. 7, when the plunger 88 is depressed, pressure within the hose 67 is released and allowed to escape through openings in the trigger valve assembly. This reduces the pressure within the hose 67 and, in turn, rapidly reduces the pressure in the lower portion of the manifold 78 beneath the plunger 79. As a consequence, pressure from within the pressure chamber 74 presses downwardly on the top of the plunger 79 causing the plunger 79 to slide down the manifold to engage and seat against the lip 82 as seen in FIG. 7. When the plunger 79 moves downwardly in this fashion, all of the pressurized air within the pressure chamber 74 is free to move through the openings 86 and into the launch tube 76. In practice, the openings 86 are sized to allow an extremely rapid release of pressurized air through the launch tube in a sudden burst. This burst of pressurized air through the launch tube 76, in turn, catapults the toy rocket into the air for flight as illustrated in FIG. 5.

The just described pressurization and release mechanism has proven to be reliable and efficient both in construction and in operation. Furthermore, with the illustrated assembly, the release trigger for launching the rocket can be located on or adjacent to the pressurization pump, which, in turn, can be located any desired distance from the actual launcher base assembly 68 by means of an appropriate length of hose 67. Thus, the operator can be located at some distance from the launcher and can both pressurize the launcher and launch the rocket from the same location. Also, only one connecting hose 67 is required between the pump and the launcher rather than a pressurization hose and a trigger hose as has sometimes been required in the prior art.

The invention has been described herein in terms of preferred embodiments and methodologies. It will be apparent to those of skill in the art, however, that numerous modifications may be made to the illustrated embodiments within the scope of the invention. For example, even though a compressed air launcher has been illustrated, virtually any other launcher likely would function equally well with the invention. Also, while springs, rubber bands, and cords have been illustrated as biasing means, these elements might well be replaced with other equivalent means of providing biasing force. In addition, variations of the illustrated embodiment of the compressed air actuated launch mechanism might also be implemented within the scope of the invention. For example, while the manifold has been described as being within the pressure chamber, such a configuration is not a necessary constraint. For instance, the manifold itself might just as well be physically located outside of the pressure chamber with a tube or conduit communicating between the manifold opening and the interior of the chamber. The manifold might also be fixed to the outside of the chamber with its opening being in direct communication with the chamber interior. Further, while it is preferred that the plunger fit loosely within the manifold and that compressed air pass around the plunger and through the opening to pressurize the chamber, the plunger might also be fabricated to fit snugly and sealingly within the manifold with compressed air from the pump passing through a second valved opening adjacent the second end of the manifold. These and other additions, deletions, and modifications might well be made to the illustrated embodiments without departing from the spirit and scope of the invention as set forth in the claims.

I claim:

1. A toy rocket with a velocity dependent chute release mechanism, said toy rocket comprising:

an elongated generally cylindrical fuselage having a nose section at its front end and a tail section at its rear end;

said fuselage being formed with a cavity extending along one side, said cavity being sized and configured to receive and contain a folded parachute;

hatch means on said fuselage, said hatch means being movable relative to said fuselage between a closed position covering and closing off said cavity for confining a folded parachute to said cavity and an open position displaced from and opening up said cavity for releasing the parachute from said cavity for deployment;

latch means on said toy rocket for releasably latching said hatch means in its closed position;

a wind velocity sensitive release trigger on said toy rocket for maintaining said latch means in a first position latching and closing said hatch when the velocity of wind streaming past said fuselage and thus the velocity of the rocket is above a predetermined value and for releasing said latch means to open said hatch when the velocity of wind streaming past said fuselage and thus the velocity of the rocket falls below the predetermined value;

said hatch means being elongated in shape with a bottom end portion and a top end portion and being hingedly attached at its bottom end portion to said fuselage adjacent the tail section thereof, said hatch means being movable at its hinged attachment between said closed position and said open position with the top end portion of said hatch means being located adjacent the nose section of said fuselage when said hatch means is in its closed position;

said latch means comprising a latch pin on the top end portion of said hatch and a latch pin keeper on said nose section of said fuselage, said latch pin keeper being movable between a first position restraining said latch pin to keep said hatch closed and a second position releasing said latch pin to open said hatch, said latch pin keeper being operably coupled to said release trigger and being adapted to move from its first position to its second position when said trigger senses a fall of wind velocity below the predetermined value.

2. A toy rocket with a velocity dependent chute release mechanism as claimed in claim 1 and wherein said wind velocity sensitive release trigger comprises a flap mounted to the nose section of said fuselage and being presented to the wind during flight of said toy rocket, said flap being movable between a first position and a second position and being oriented so that wind streaming past the fuselage during flight of said toy rocket compresses against said flap to hold the flap in its first position, and means on said fuselage for biasing said flap toward its second position with a biasing force selected to be less than the force of the wind on said flap when the wind velocity and thus rocket velocity is above the predetermined value and greater than the force of the wind on said flap when the wind velocity and thus rocket velocity is below the predetermined value, said release trigger being adapted to release said latch means when said flap moves from its first position to its second position, whereby the flap is urged to move from its first position to its second position when the wind velocity and thus rocket velocity falls below the predetermined value to release the latch means, open the hatch, and deploy the parachute to ease the rocket back to earth.

3. A toy rocket with a velocity dependent chute release mechanism as claimed in claim 1 and further comprising a launcher for launching said toy rocket into the air, said launcher having means for holding said release trigger in its hatch closing position prior to launch of said toy rocket.

4. A toy rocket with a velocity dependent chute release mechanism as claimed in claim 3 and wherein said means for holding said release trigger in its hatch closing position prior to launch comprises a hinged spring-biased lid on said launcher that bears against said release trigger prior to launch and that is hinged by the moving rocket during launch to a position displaced from the rocket.

5. A toy rocket with a velocity dependent chute release mechanism as claimed in claim 1 and wherein said parachute has a plurality of parachute cords fixed to the parachute and extending therefrom to free ends and wherein said parachute cords are fixed at their free ends to said hatch means whereby movement of said hatch means from its closed position to its open position draws the parachute cords and the parachute out of the cavity to deploy the parachute for use.

6. A toy rocket system comprising:

a fuselage having a nose section and a tail section;

launcher means for launching said toy rocket into the air;

a parachute stowed in said fuselage and being deployable during rocket flight;

deployment means for deploying said parachute when said deployment means is triggered;

trigger means responsive to the velocity of said toy rocket for triggering said deployment means when the rocket's velocity falls below a predetermined deployment velocity, said trigger means comprising a nose cone hingedly attached to said fuselage at the nose section thereof, said nose cone being movable at its hinged attachment between a closed position wherein said nose cone is substantially co-extensive with said fuselage and securing said deployment means and an open position wherein said nose cone is swung away from said fuselage triggering said deployment means for deployment of said parachute; and means for biasing said nose cone toward its open position with a force sufficient to overcome the force of wind on said nose cone when said rocket slows to predetermined velocity to move the nose cone to its open position and trigger the deployment means, whereby the rocket is launched into the air and, when the rocket slows to a velocity less than the predetermined deployment velocity, the nose cone flips open to release the deployment means and the parachute is deployed to ease the rocket slowly back to earth.

7. A velocity dependent release mechanism for use on an object moving through a fluid medium to trigger an event when the velocity of the object through the medium falls below a predetermined value, said mechanism comprising latch means on said object with said latch means having a secured position preventing the occurrence of the event and a released position permitting the occurrence of the event, a fluid velocity sensitive release trigger on said object for maintaining said latch means in its secured position when the velocity of the object through the fluid medium is greater than the predetermined value and for releasing said latch means for movement to its released position when the velocity of the object falls below the predetermined value, said release trigger comprising a hinged flap having a flap surface, said flap being moveable between a closed position securing said latch means and an open position releasing said latch means and including biasing means for biasing said flap toward its open position, said flap surface being exposed to fluid flow past the object as the object moves through the fluid medium and being oriented so that the flow creates force on said flap surface that tends to hold said flap in its closed position against the force of said biasing means until the velocity of the moving object and thus the force created by the fluid flow on the flap surface falls below the force of said biasing means, whereupon said biasing force moves said flap to its open position releasing said latch means to trigger the event;

said object comprising a toy rocket having a nose section and a tail section, said flap being disposed at the nose section of said toy rocket;

said toy rocket being generally cylindrical in shape having a radius and a perimeter, said latch means being hingedly attached at one end to said toy rocket adjacent the perimeter thereof and said flap being hingedly attached to said latch means at a radially inwardly displaced position relative to the hinged attachment of said latch means.

8. A velocity sensitive trigger mechanism for triggering an event when the velocity of an elongated projectile through the air falls below a predetermined value, said trigger mechanism comprising, in combination, a tripping element movable between a securing position and a releasing position and being adapted to activate said trigger mechanism to trigger the event when said tripping element moves to its second position, a nose cone section hingedly attached to the forward end of said elongated projectile, said nose cone section being movable at its hinged attachment between a first position substantially co-extensive with said projectile and a second position swung away from said projectile, said nose cone section, when in its first position, holding said tripping element in its securing position and, when in its second position, allowing said tripping element to move to its releasing position, and means for biasing said nose cone section toward its second position with a biasing force sufficient to move said nose cone section to its second position when the force of wind on the nose cone section falls below a predetermined value.

* * * * *